United States Patent [19]

Gibson

[11] 4,433,790

[45] Feb. 28, 1984

[54] TAMPER-PROOF CLOSURE

[75] Inventor: Royal H. Gibson, Rumson, N.J.

[73] Assignee: Gibson Associates, Inc., Cranford, N.J.

[21] Appl. No.: 467,817

[22] Filed: Feb. 18, 1983

[51] Int. Cl.[3] ..... B65D 41/02; B65D 41/32

[52] U.S. Cl. ..... 215/246; 215/250; 215/251; 215/206; 215/223; 215/225

[58] Field of Search ..... 215/203, 204, 206, 223, 215/224, 225, 250, 251

[56] References Cited

U.S. PATENT DOCUMENTS

| | | | |
|---|---|---|---|
| 3,838,785 | 10/1974 | Lancesseur | 215/251 |
| 3,952,901 | 4/1976 | Conti | 215/251 |
| 4,280,631 | 7/1981 | Lohrman | 215/204 |

*Primary Examiner*—George T. Hall

*Attorney, Agent, or Firm*—Hopgood, Calimafde, Kalil, Blaustein & Judlowe

[57] ABSTRACT

The invention contemplates a container closure, with a frangible cover preassembled thereto, such that both the closure and the cover have independent snap-lock engagement to the container-neck finish, in a single axially displaced assembly of both of the preassembled parts to the neck finish. The cover must be broken to gain access to container contents, so that any breakage provides a direct warning as to possible tampering. In the disclosed embodiment, the closure which remains after destruction and removal of the cover, has child-safety features, in respect of its snap-action engagement to the neck finish.

16 Claims, 6 Drawing Figures

TAMPER-PROOF CLOSURE

BACKGROUND OF THE INVENTION

The invention relates to a safety-closure system for the open end, such as the dispensing neck, of a container, whereby any tampering with contents prior to customer purchase may be immediately noticed by the customer, thus warning the customer against making the purchase.

Various schemes have been used in the past to warn a customer that container contents may have had tampering access prior to sale to the customer. In general, such schemes may be characterized as requiring a closure plug or cap, and some kind of covering device in the nature of a breakable seal or cover member, which must be broken to gain access to the plug or cap. Thus, the filling house which fills containers with consumable product must perform separate operations, to successively install the closure plug or cap, and then to install the seal or cover member. These separate operations, and the separate handling of these separate parts, necessarily mean substantial expense as compared to merely making the closure alone.

BRIEF STATEMENT OF THE INVENTION

It is an object of the invention to provide an improved container-closure system of the character indicated.

It is a specific object to provide such a closure system wherein both the closure device and a tamper-indicative cover are preassembled components, adapted to conjoint assembly to a container, in a single operation which lends itself to automation.

Another specific object is to achieve the above objects with a construction which incorporates child-safety features in the closure device per se.

The invention achieves the foregoing objects in a construction in which a closure cap and a frangible cover are preassembled components, adapted for supply to a filling house in their preassembled relation. Each of these components has its own means of independent snap-action engagement to neck-finish beading on the container to which the preassembled components are to be ultimately assembled. A single axially directed thrust of the preassembled components over the neck of a filled container is the only closure operation needed, and the result is not only to effect container closure but also to make it necessary to break and thus destroy the cover if access is to be gained to the contents of the container.

DETAILED DESCRIPTION

The invention will be described in detail for a preferred embodiment, in conjunction with the accompanying drawings. In said drawings.

Figure 1:
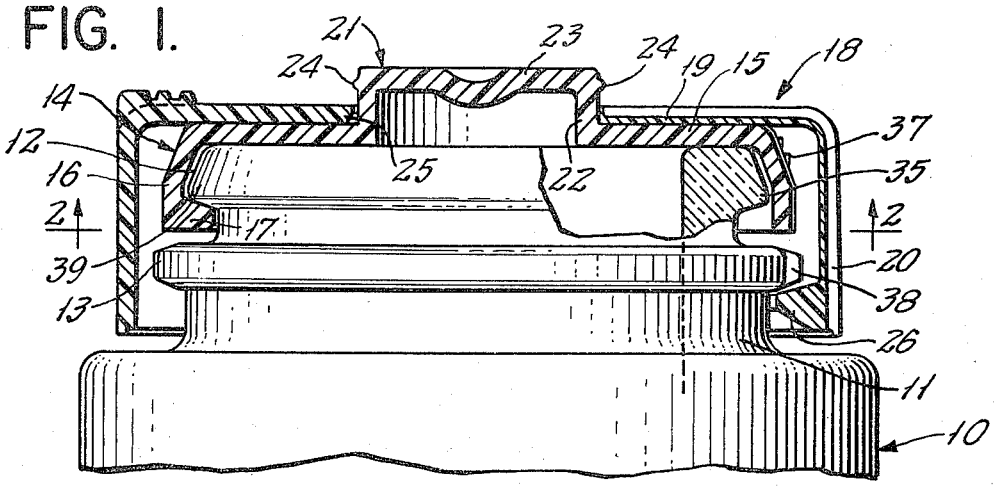
FIG. 1 is an enlarged fragmentary view in elevation to show the neck region of a container closed and tamper-protected by the invention, engaged parts being broken-away and in vertical section to reveal their coaction.
Figure 2:
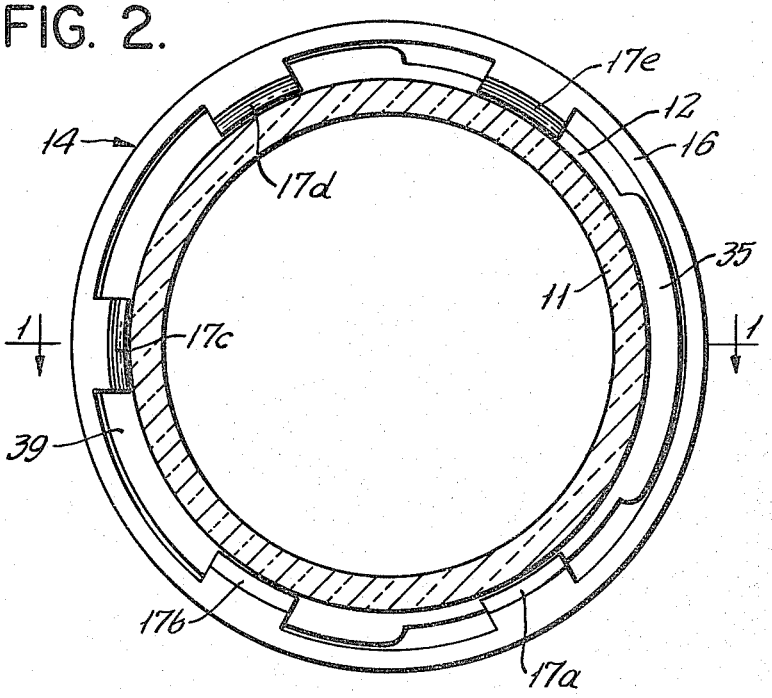
FIG. 2 is a cross-sectional view taken at 2—2 in FIG. 1, the plane of the sectioning of FIG. 1 being indicated at 1—1 in FIG. 2.

In FIGS. 1 and 2, a bottle 10, shown sectioned for glass, has a reduced neck 11, externally characterized by a "finish" comprising axially spaced first and second circumferentially continuous bead formations 12–13. The axially outer bead 12 is of outer diameter greater than that of the axially inner bead 13. A closure cap 14 is preferably a single injection-molded plastic part, wherein the plastic material, suitably polypropylene, is stiffly complaint. Cap 14 is cup-shaped and comprises a closed end portion 15 and a dependent skirt portion 16; and plural angularly spaced inward lugs 17 within the lower end of the skirt have snap-action engagement over the outer bead 12, when the closed end 15 is seated upon the open end of the neck.

A frangible cover or cage 18, which may also be a single injection-molded compliant part, suitably of polystyrene, surrounds cap 14 and forms part of a subassembly with cap 14. Cover 18 is generally cup-shaped, having an end-wall portion 19 and a dependent skirt portion 20. Interengaging means coacting between cover 18 and cap 14 retain their subassembled relationship. In the form shown, this is accomplished by a central stud-like offset 21 in the cap closure wall 15, and the offset 21 comprises a cylindrical wall portion 22 and an end-closure wall portion 23. Plural outward rib formations 24 in wall 22 provide detent retention of cover 18 via engagement at the rim 25 of a central opening in the end-wall portion 19. The skirt 20 of cover 18 extends past inner bead 13, and plural angularly spaced inward lugs 26 within the lower end of skirt 20 have snap-action engagement over the inner bead, at the time when lugs 17 of cap 14 have similar engagement over the outer bead 12. It will be appreciated that offset 21 projects beyond the end-wall portion 19 of the cover, thus providing a simple centering reference for automated handling of parts 14–18 in their subassembled relation, and that the essentially radial-plane nature of both end-wall portions 15–19 provides relatively large-area exposure for such tooling to drive the subassembly into both snap-action engagements, in one and the same operation.

Figure 3:
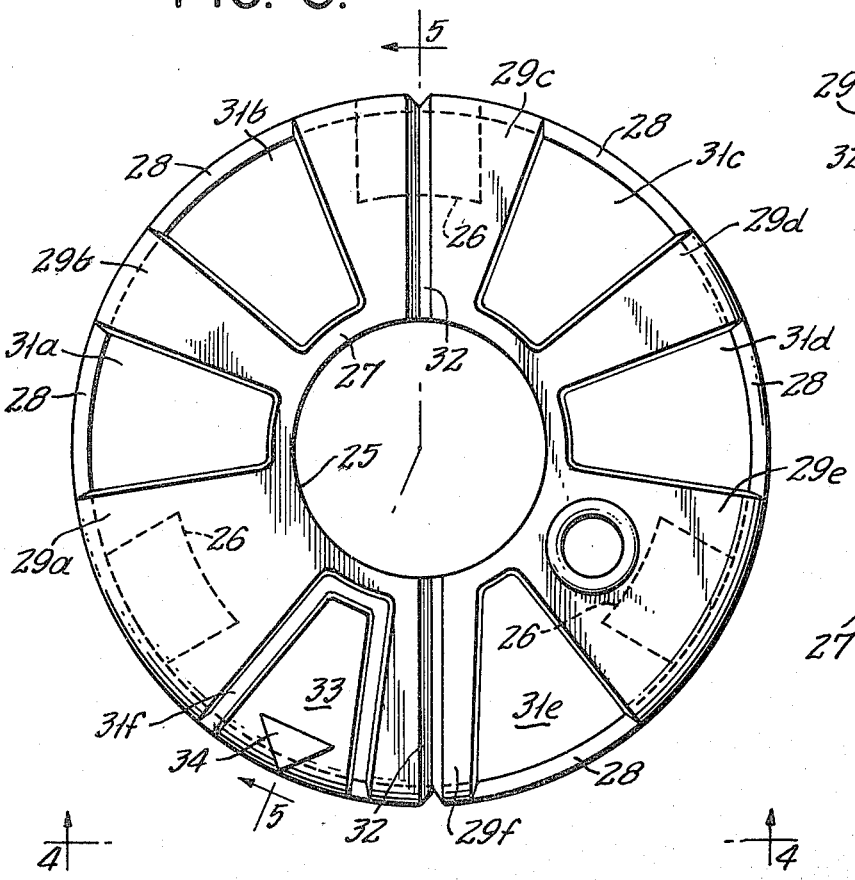
FIG. 3 is a plan view of the tamper-protection component of FIG. 1.
Figure 5:
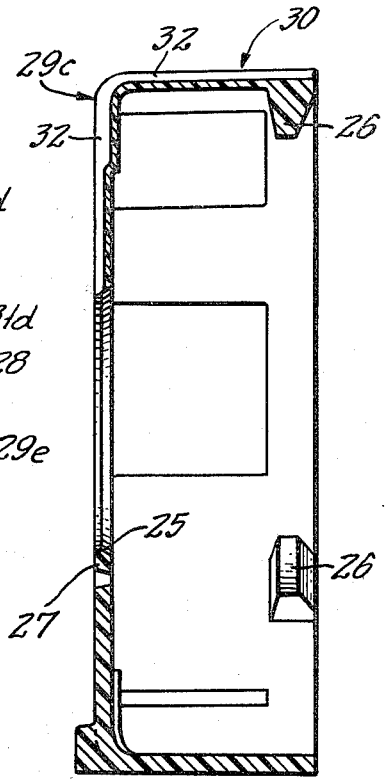
FIG. 5 is a sectional view, taken at alignments 5—5 in FIG. 3.
Figure 4:
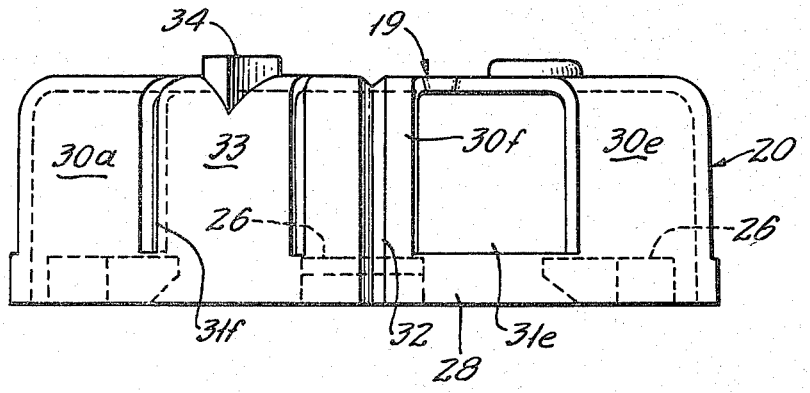
FIG. 4 is a side view in elevation, from the aspect 4—4 of FIG. 3.

Having thus described the overall relationship, attention will now focus on further details of the preferred embodiment shown, commencing with the cover or cage 18, as particularly shown in FIGS. 3 to 5. The end-wall and skirt portions 19–20 of cover 18 are both fenestrated, between an inner circumferentially continuous annulus 27 (the bore of which establishes rim 25) and an outer circumferentially continuous annulus 28 at the lower end of skirt portion 20. Angularly spaced sector elements 29 of end-wall portion 19 extend radially outward from annulus 27 to integral connection with corresponding angularly spaced arcuate strips 30 having integral connection with the outer or skirt annulus 28; six such connections are shown, and for convenience they are individually identified *29a, 29b . . . 29f,* and *30a, 30b . . . 30f,* with fenestration openings *31a, 31b . . . 31f* interlaced therebetween, in the manner of a cage. Cover 18 is rendered frangible (tearable) along the intercept of a diametrical plane which includes the central axis of cover 18 and which appears as a continuous outwardly open V-groove 32, symmetrically dividing in half, the sectors 29c–29f and their associated skirt strips 30c–30f. The upper half of the section of FIG. 5 shows groove 32 to be deeper than half the thickness of the involved wall elements 29c/30c (29f/30f).

Inspection of FIG. 3 reveals inward lugs 26 to be at three equally spaced locations, centered on the alignment of wall elements 29a/30a, 29c/30c, and 29e/30e, respectively. Such a lug 26 thus reinforces the groove-weakened annulus 28 at wall element 30c, but leaves annulus 28 groove-weakened at wall element 30f. Cover 18 is therefore configurated to invite initial breakage at wall elements 29f/30f, the involved configuration being a pull-out tab 33, integrally formed with annulus 28 in the fenestrated opening 31f and exposing an arrowhead 34 or other indicium to invite finger-grasp and pull-out for breakage of wall elements 29f/30f. Once broken along groove 32 as far as rim 25, cover 18 is easily removed from retention by detent ribs 24, and it may be discarded, leaving cap 14 in latched retention of the bottle-closed relationship.

Returning now to FIGS. 1 and 2, the bottle-closed relationship is seen to be retained by five angularly spaced lugs 17a, 17b . . . 17e, all of which engage under the upper bead 12 of the neck finish. Lugs 17a, 17b . . . 17e are in arcuate succession, at substantially 60-degree spacings, whereby a double spacing (without a sixth such lug) exists between adjacent lugs 17a and 17e at arcuate limits of the succession. Within this double spacing, and when oriented as in FIG. 2 with respect to the neck finish, a first local outward projection 35 of bead 12 is angularly centered in the double spacing, so that no lug 17 exists to preclude or interfere with local upward deforming displacement of the involved local region of the cap skirt 16. Such upward displacement further so transiently distorts skirt 16 as to withdraw lugs 17a and 17e from retaining engagement with bead 12, to an extent then permitting the remaining lugs 17b to disengage from bead 12. To assure that such cap removal is possible at essentially only one angular relation between the cap and the bottle, each of these parts is provided with an external indicium. In the case of cap 14, angularly localized friction ribs 37 (FIG. 1) are part of the external finish of skirt 16, essentially local to the midpoint at the double space between lugs 17a and 17e. In the case of neck 11, a local discontinuity or notch 38 in bead 13 is part of the finish of bead 13, in angular register with the midpoint of the described configuration, the angular extent of bead projection 35 should be less than the double space between lugs 17a and 17e, and it is suitably about 60 degrees, as shown in FIG. 2.

In use, cap 14 is rotatable in its secured relation, while lug-engaged to bead 12, but rotation to the point of angular registry of the indicia 37–38 will enable the lift-off and transient deformation described above for cap removal. Cap replacement is thereafter non-ciritcal as to angular relation between the cap and the neck, it being only necessary to press cap 14 down onto neck 11 until lugs 17 engage under bead 12, with snap action.

In order to preclude cap removal at any other angular cap/bottle relation, i.e., other than that described for registration of indicia 37–38, bead 12 is seen in FIG. 2 to include a second and angularly more extensive local outward projection 39, having diametrically opposite symmetry with respect to outward projection 35. The angular extent of projection 39 is preferably at least 160 degrees and is seen in FIG. 2 to be substantially 180 degrees about the axis of the neck finish.

The described construction will be seen to achieve the stated objects and to be relatively simple to implement. Bottle closure is well maintained by the five lugs 17 engaged to bead 12, even if cap 14 is rotated to the angle at which indicia 37–38 are in register. Such retention is attributable to the fact that the double spacing between lugs 17a and 17e is less than 180 degrees, being slightly less than 120 degrees in the form shown. Snap-engagement of lugs 17 over bead 12, and of lugs 26 over bead 13, is facilitated by conically tapering the lug and bead surfaces which must engage, for outwardly camming the involved lugs 17 (26) in the course of forcing the lugs to ride over the involved beads. Such outward displacement of lugs is of course local to the involved lugs, and in the angular space between lugs there must be sufficient net radial clearance to accommodate the radially inward displacement which the involved skirt or hoop 16 (28) must undergo as it transiently passes from a state of cylindrical continuity, to a state approaching polygonal continuity, and then returning in approach to cylindrical continuity, once the involved lugs 17–26 have snap-engaged their involved beads 12–13. A conical taper in the opposite direction is also desirable for the faces of lugs 17 (24) which engage under similarly sloped lower edges of the involved beads 12 (13), so that remnant hoop tension in the respective skirts (and in particular, in the cap skirt 16) is available to radially inwardly load the lug engagements after snap action.

Figure 6:
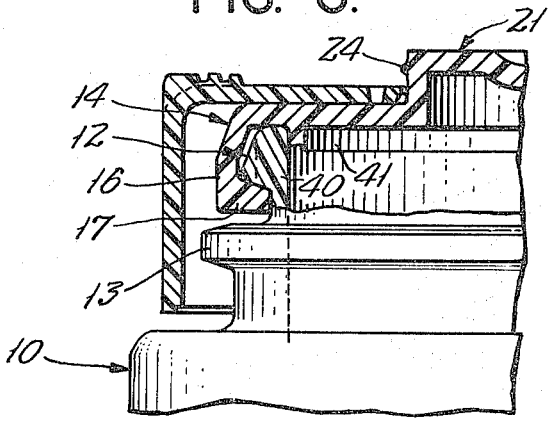
FIG. 6 is a fragmentary view, similar to FIG. 1 but for half the section, to show a modification.

While the invention has been described in detail for a preferred form, it will be understood that modifications may be made without departure from the scope of the invention. For example, the number of snap-action lugs and their spacing is, to a degree, a matter of choice, it being sufficient for child-safety purposes that whatever the lug-to-bead configuration, there shall be only one angular relation at which the cap can be removed. Also, the illustrative use of a glass bottle 10 in the described embodiment is not to be understood as imposing limitation on the use of plastic bottles; in FIG. 6, for example, the bottle 10' is of blow-molded plastic with precisely the same external neck finish as described for glass bottle 10 of FIG. 1, so that the same cap 14 and cover 18 are directly usable in assembly to the plastic bottle 10' of FIG. 6. However, the ability to hold closer tolerances in plastic-bottle manufacture means a more precisely defined neck bore 40 in FIG. 6, thereby permitting the use of a cap 14' having an inner skirt formation 41 for sealing coaction with the neck bore 40, upon cap closure.

What is claimed is:

1. As an article of manufacture, a cup-shaped container-closure cap having a cylindrical skirt and a closure end, a frangible cover surrounding the closed end and skirt of said cap, and interengaged means on said cover and cap retaining their assembled relation, said cap and said cover each being of stiffly yieldable plastic material, radially inward container-bead engaging means integrally formed with said skirt at the open end of said cap, said frangible cover being circumferentially continuous at least in a region axially beyond the open end of said skirt, and radially inward container-bead engaging means integrally formed with said cover at said circumferentially continuous region.

2. The article of claim 1, in which the radially inward bead-engaging means of said cap comprises an angularly spaced plurality of lug formations.

3. The article of claim 1, in which the radially inward bead-engaging means of said cover comprises an angularly spaced plurality of lug formations.

4. The article of claim 2, in which said plurality is an arcuate succession of five, at substantially 60-degree spacings, whereby a double spacing without a lug exists between arcuate limits of said succession.

5. The article of claim 3, in which said plurality is at least three, at equal angular spacings.

6. The article of claim 1, in which the bead-engaging means of said cap is sized for snap-engagement over a first neck-finish bead of a container closable by said cap, and the bead-engaging means of said cover is sized for snap-engagement over a second neck-finish bead of a container closable by said cap.

7. The article of claim 1, in which said cover is a fenestrated cage terminating at the circumferentially continuous region, and the bead-engaging region of said cap is formed for local axial separation from an angularly localized region of the neck finish of a container closable by said cap, and an angularly localized indicium on said cap and referenced to the local axial-separation region of said cap.

8. The article of claim 1, in which said cover and cap are interengaged members and in which the interengaged means on said cover and cap comprises on one of said members a central axial projection with radially outward snap-retention lugs and on the other of said members a central opening having an inner rim engaged over and retained by said lugs.

9. The article of claim 1, in which a second skirt depends integrally from the closed end of said cap and in radially inwardly offset relation to said first-mentioned skirt, said second skirt being formed for sealing coaction with the bore of the neck finish of a container closable by said cap.

10. In combination with the article of claim 1, a container having a neck finish with first and second axially spaced peripheral beads, the bead-engaging means of said cap engaging the axially outer one of said beads, and the bead-engaging means of said cover engaging the axially inner one of said beads.

11. In combination, the article of claim 1 and a container having a neck finish characterized by axially spaced first and second circumferentially continuous beads, the bead-engaging means of said cap skirt being engaged to the axially outer one of said neck beads, and the bead-engaging means of said cover being engaged to the axially inner one of said neck beads.

12. In combination, the article of claim 4 and a container having a neck finish characterized by axially spaced first and second circumferentially continuous beads, the lug formations of said cap skirt being engaged to the axially outer one of said neck beads, and the bead-engaging means of said cover being engaged to the axially inner one of said neck beads, the axially outer neck bead being characterized by a first predominant radially outward projection of about 60-degree arcuate extent and by a second predominant radially outward projection of at least 160-degree arcuate extent, the respective midpoints of said outward projections being diametrically opposed.

13. The article of claim 3, in which said cover is frangible by reason of a locally weakened tear line extending radially between two adjacent fenestration openings and continuing axially to and including said circumferentially continuous region, said tear line being also at an angular location between adjacent bead-engaging lug formations.

14. In combination, a container having a neck with an external finish characterized by a circumferentially continuous radially outward bead, and a cup-shaped closure cap of stiffly deformable plastic and having a cylindrical skirt and a closure end, said skirt having a plurality of at least four angularly spaced integrally formed radially inward lugs having snap-engagement over said neck bead to effect cap closure of the container, there being a space of at least 90 degrees between two adjacent lugs of said plurality, said neck bead being characterized by a first predominant radially outward projection of less than 90-degrees arcuate extent and by a second predominant radially outward projection of at least 160-degree arcuate extent, the respective midpoints of said outward projections being diametrically opposed, and angularly local externally exposed indicia on said cap and container to indicate upon their angular registration that said first projection is within the space between said two adjacent lugs.

15. The combination of claim 14, in which said plurality is an arcuate succession of five, at substantially 60-degree spacings, said two lugs being at the arcuate limits of said succession, whereby the space between said two lugs is substantially a double spacing.

16. The combination of claim 14, in which the arcuate extent of said second projection is substantially 180 degrees.

* * * * *